US006413065B1

(12) United States Patent
Dass

(10) Patent No.: US 6,413,065 B1
(45) **Date of Patent: *Jul. 2, 2002**

(54) MODULAR DOWNHOLE MULTIPHASE PUMP

(76) Inventor: Pradeep Dass, c/o Can-K Process & Mining Equipment Ltd. Manulife Place Suite 1810 10180-101 Street, Edmonton, Alberta (CA), T5J 3S4

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,557

(22) Filed: Mar. 30, 1999

Related U.S. Application Data

(60) Provisional application No. 60/099,525, filed on Sep. 9, 1998.

(51) Int. Cl.[7] ..... F01C 1/16

(52) U.S. Cl. ..... 418/201.1; 418/200; 418/206.1

(58) Field of Search ..... 418/200, 201.1, 418/206.1

(56) References Cited

U.S. PATENT DOCUMENTS

| | | | | | |
|---|---|---|---|---|---|
| 677,758 | A | * | 7/1901 | Angturbine | 418/200 |
| 750,532 | A | * | 1/1904 | George | 418/200 |
| 1,423,768 | A | * | 7/1922 | Holdaway | 418/201.1 |
| 1,430,894 | A | * | 10/1922 | Fay | 418/200 |
| 1,751,703 | A | * | 3/1930 | Long | 418/201.1 |
| 1,762,708 | A | * | 6/1930 | Allred | 418/201.1 |
| 2,100,560 | A | * | 11/1937 | Kennedy | 418/201.1 |
| 5,779,451 | A | | 7/1998 | Hatton | |

FOREIGN PATENT DOCUMENTS

| | | | | |
|---|---|---|---|---|
| JP | 0218681 | * | 9/1987 | 418/201.1 |
| JP | 0218682 | * | 9/1987 | 418/201.1 |
| JP | 0245493 | * | 10/1990 | 418/201.1 |
| JP | 405018379 | * | 1/1993 | 418/200 |

* cited by examiner

*Primary Examiner*—Thomas Denion
*Assistant Examiner*—Theresa Trieu
(74) *Attorney, Agent, or Firm*—Christensen O'Connor; Johnson Kindness PLLC

(57) ABSTRACT

A modular downhole pump includes a gear module for transferring power to the pump from a sucker rod or a downhole motor and a rotor module. The rotor module includes a pair of counter-rotating, interleaved rotors split into an upper pair and a lower pair which pump fluids in opposite directions within the rotor module. The rotor modules may be configured to increase the pressure capacity or the volume capacity of the pump and may be connected in series to achieve the desired volume and pressure output.

10 Claims, 7 Drawing Sheets

MODULAR DOWNHOLE MULTIPHASE PUMP

This application claims the benefit of the filing date of U.S. Provisional Application No. 60/099,525 filed Sep. 9, 1998.

FIELD OF THE INVENTION

The present invention relates to a downhole pump for producing oil and gas wells, and more particularly to a modular downhole multiphase pump.

BACKGROUND OF THE INVENTION

Downhole pumps are used to provide artificial lift in order to produce petroleum products from oil and gas wells. Conventional downhole pumps include pumpjack type pumps, progressive cavity pumps ("PC pumps") and electric submersible pumps (or "ES pumps").

ES pumps are downhole centrifugal pumps to which power is supplied by a cable running though the well bore from the surface. These pumps are well known and widely used but suffer from comparatively low pumping efficiency and an inability to handle solids entrained in the production fluid.

PC pumps are well known and use a metal rotor rotating within an elastomeric stator to lift production fluids to the surface through the well's tubing string. PC pumps may be powered from a surface top drive through a sucker rod or by electric submersible motors located below the pump at the end of the tubing string. While an improvement over walking beam pumps, conventional PC pumps present many disadvantages. The abrasive downhole environment quickly degrades the elastomeric stator. Aromatic compounds may cause the stator to blister and degrade. The frictional contact between the rotor and stator also wears out both the rotor and the stator. Replacing or repairing a downhole PC pump involves expensive downtime for the well because the entire tubing string must be pulled up by a service rig.

As well, PC pumps are most efficient if they are pumping liquids only. They do not function well with multiphase operations with high gas content. Very often, gases and solids are produced with liquids and may cause rapid degradation and wear in the PC pump.

Another significant problem with PC pumps is the potential for backspinning caused by reverse flow of fluid through the pump. This situation may occur if an electrically powered top drive unit suffers a power failure. A typical well may have a PC pump which is hundreds of meters underground. The column of production fluid within the tubing string will fall back through the PC pump, causing the pump, the sucker rod and associated surface machinery to backspin at very high rates. In some cases, the backspinning may cause components in the top drive to fail catastrophically, with the potential to injure personnel in the vicinity of the top drive.

Therefore, there is a need in the art for a downhole pump which migrates the disadvantages of the prior art above.

SUMMARY OF THE INVENTION

In general terms, the invention comprises a modular pump for underground use in connection with an oil well having a drive source which may be a surface drive which rotates a sucker rod or which may be a downhole motor. In one aspect of the invention, the pump comprises:

a) a rotor module comprising:

i) a cylindrical housing having a bottom face, a top face, a cylindrical face, an inlet, an outlet and an internal rotor enclosure between said inlet and outlet;

ii) at least one pair of intertwined and counter-rotating rotors within the internal rotor enclosure;

iii) means for rotating the rotors; and b) a gear module having means for connecting to the drive source and means for outputting power to the rotor module.

The rotor module preferably comprises an upper and a lower pair of rotors separated by an intake plenum wherein the upper pair of rotors drives fluid upwards into an outlet plenum and the lower pair of rotors drives fluid downwards into a fluid passage which then joins the outlet plenum. The rotor module housing inlet preferably comprises an intake opening in the cylindrical face of the housing, which is in fluid communication with the intake plenum. Alternatively, the rotor module housing inlet comprises an opening defined in the bottom face of the housing and a inlet passage connecting the opening with the intake plenum.

In a preferred embodiment, the pump comprises at least one rotor module housing (hereinafter referred to as a "volume module") having an inlet comprising an intake opening around the circumference of the housing, which is in fluid communication with the intake plenum; and at least one rotor module housing (hereinafter referred to as a "pressure module") having an inlet comprising an opening defined in the bottom face of the housing and a inlet passage connecting the opening with the intake plenum, wherein the outlet of the volume module connects with the inlet of the pressure module. More preferably, the pump further comprises a plurality of volume and pressure modules connected in series wherein the pressure modules are arranged in ascending order of pressure capacity.

The gear module may be adapted for use with a sucker rod as a power source, in which case it preferably is a speed increaser, or the gear module may be adapted for use with a downhole electrical motor as a power source. In addition, gear modules may be provided to transfer power from one rotor module to another.

In another aspect of the invention, the invention comprises a rotor module for use in assembling a modular pump for underground use in connection with an oil well, said rotor module comprising a cylindrical housing having an upper surface, a circumferential surface, a bottom surface and defining an internal rotor enclosure, said rotor module characterized in that:

(a) the bottom surface defines an fluid intake opening and a bypass opening;

(b) the circumferential surface defines a lateral intake opening; and (c) the upper surface defines a bypass outlet opening and a fluid outlet opening;

wherein each of the openings communicates with the rotor enclosure and some of the openings may be plugged while others are kept open to control the flowpath of fluid into and out of the housing such that two or more rotor modules may be connected in series to increase the pressure and/or volume capacity of the pump.

In another aspect of the invention, the invention comprises a modular pump for underground use comprising at least one volume rotor module and at least one pressure rotor module connected in series wherein:

(a) the volume rotor module comprises a housing defining a rotor enclosure including an intake plenum, a flow inlet opening communicating with the intake plenum, interleaved and counter-rotating rotors within the rotor enclosure, and a flow outlet opening; and (b) the pressure rotor module comprises a housing defining a rotor enclosure including an intake plenum, a single inlet opening which communicates with the flow outlet opening of the volume rotor module and with the intake plenum, interleaved and counter-rotating rotors within the rotor enclosure, and a flow outlet opening; and (c) means for rotating the rotors in each of the volume rotor module and the pressure rotor module.

In the preferred embodiment, the modular pump comprises a plurality of volume rotor modules and a plurality of pressure rotor modules connected in series and in each such module, the intake plenum is a substantially central portion of the rotor enclosure and the rotors comprise an upper and a lower rotor pair which pump fluid in opposite directions such that each module is hydraulically balanced.

BRIEF DESCRIPTION OF THE DRAWINGS

The invention will now be described by way of exemplary embodiments with reference to the accompanying simplified, diagrammatic, not-to-scale drawings. In the drawings.

DETAILED DESCRIPTION OF THE INVENTION

Figure 1:
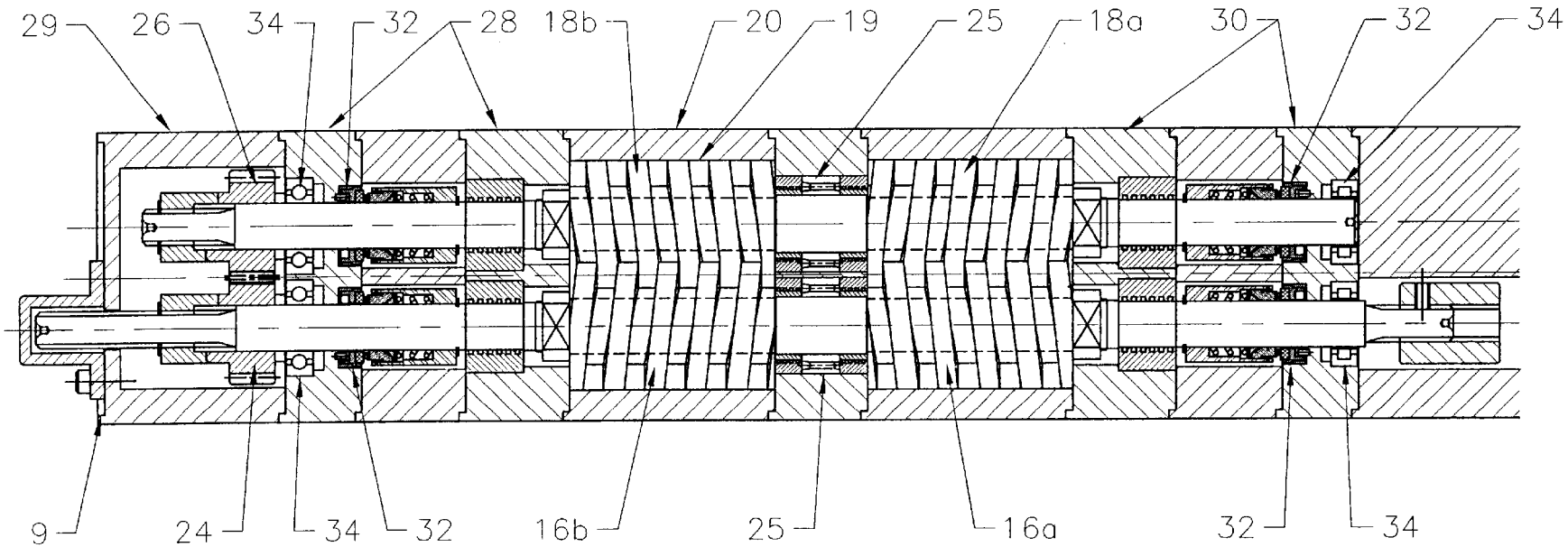
FIG. 1 is a cross-sectional view of a preferred embodiment of a rotor module.

The downhole pump assembly (10) according to the Figures comprises a gear module (12) and a rotor module (14). The following description will refer to the pump (10) having a top end (8) and a bottom end (9) as if the pump (10) is vertically oriented. It will be understood that in certain applications involving slant or horizontal wells, the pump (10) may be at an angle or horizontally oriented when installed and operated.

In a preferred embodiment the rotor module (14) comprises interleaved rotors (16, 18) which run axially within a rotor enclosure (19) formed by a rotor housing (20). A pump drive (not shown) is connected to the gear module (12) which in turn powers an input shaft (22) which rotates the first rotor (16). A drive gear (24) engages a second gear (26) to drive the second rotor (18) at an equal speed but in the opposite direction. The drive gears (24, 26) are timed to prevent physical contact between the rotors (16, 18) as they counter-rotate.

While the preferred embodiment illustrated and described herein is a twin-rotor pump, it will be understood by persons skilled in the art that three or more rotors may be interleaved and timed in a similar fashion and such multi-rotor pumps shall fall within the scope of the invention claimed herein.

The rotor module (14) further comprises seal housings (28, 30) at either end of the main rotor housing (20) and a gear housing (29) at the lower end of the rotor module (14). The seal housings (28, 30) contain mechanical seals (32) for maintaining a fluid-tight seal around the rotor enclosure (19). Ball or roller bearings (34) support the rotor shafts at either end of the rotor module (14) and needle bearings (36) are provided in the intake plenum (38) between the upper rotor pair **(16*a*, 18*a*) and the lower rotor pair (16*b*, 18*b*)**.

In the preferred embodiment, the rotor module (14) may be configured as a volume increasing module (14V) or a pressure increasing module (14P). In a pump configuration where only one rotor module is provided, it is unimportant which rotor module configuration is used, however, it will be preferred to use a volume module as depicted in FIG. 6. The present invention provides a pump (10) where two or more rotor modules (14) of either variety may be connected in series to increase the volume and pressure capabilities of the pump (10).

Figure 3:
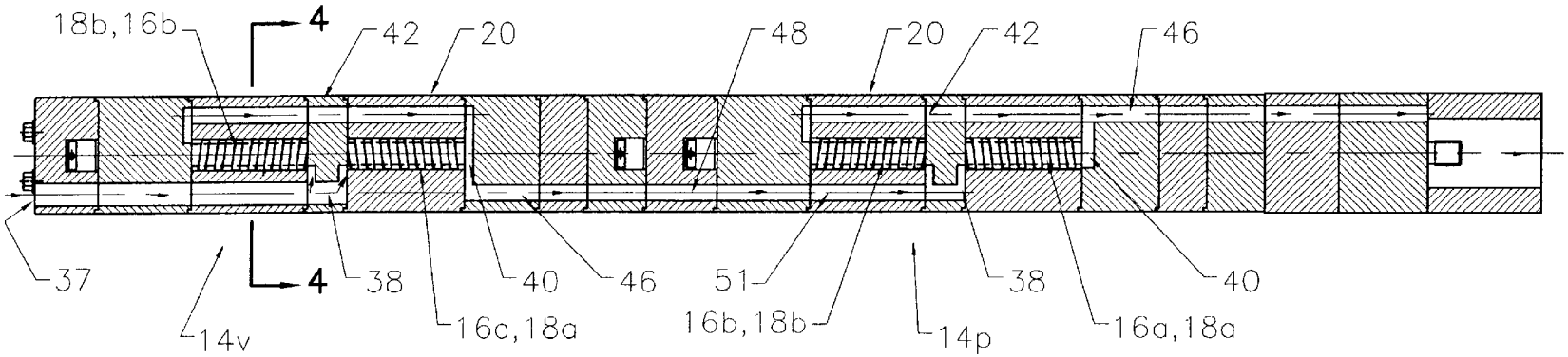
FIG. 3 is a cross-sectional view of the embodiment shown in FIG. 2 along a plane normal to the plane of view in FIG. 2.
Figure 4:
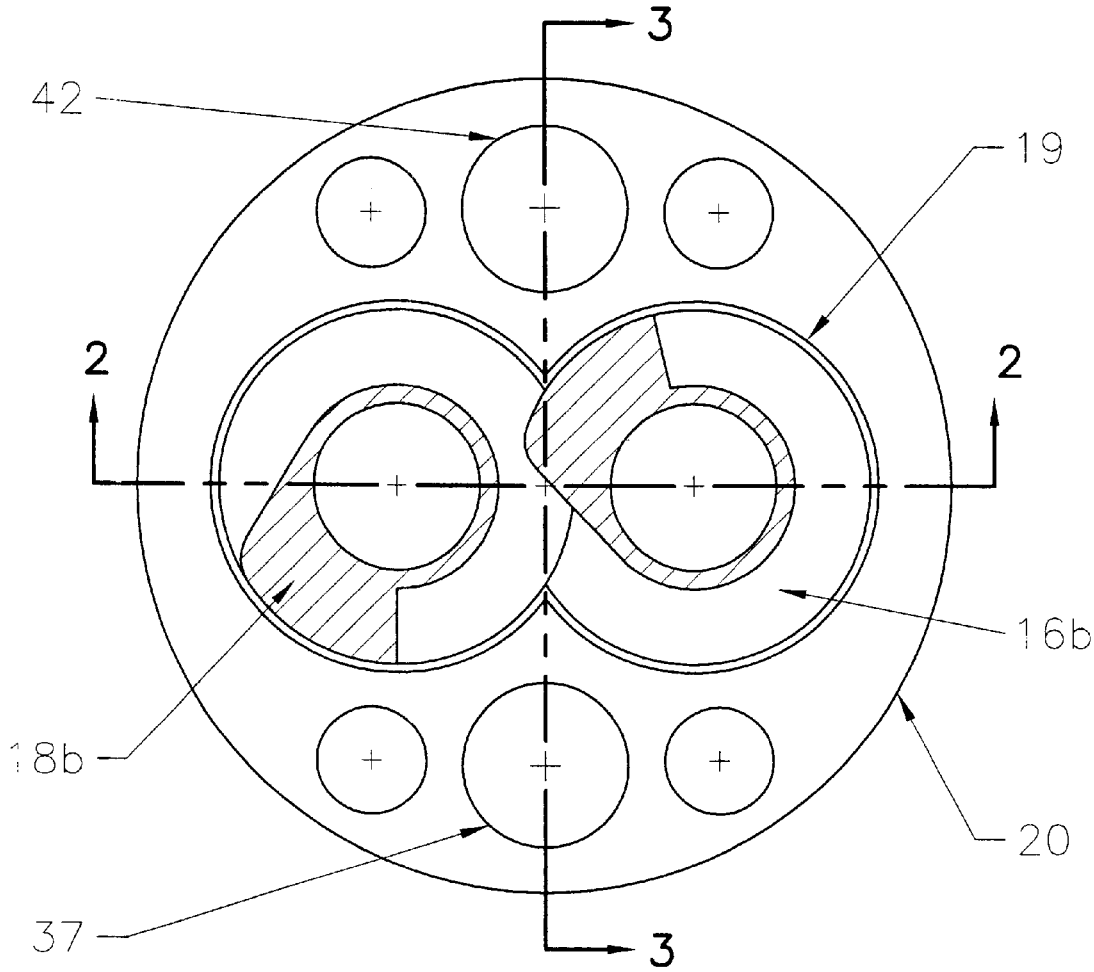
FIG. 4 is a cross-sectional view along line 4—4 in FIGS. 2 and 3.
Figure 5:
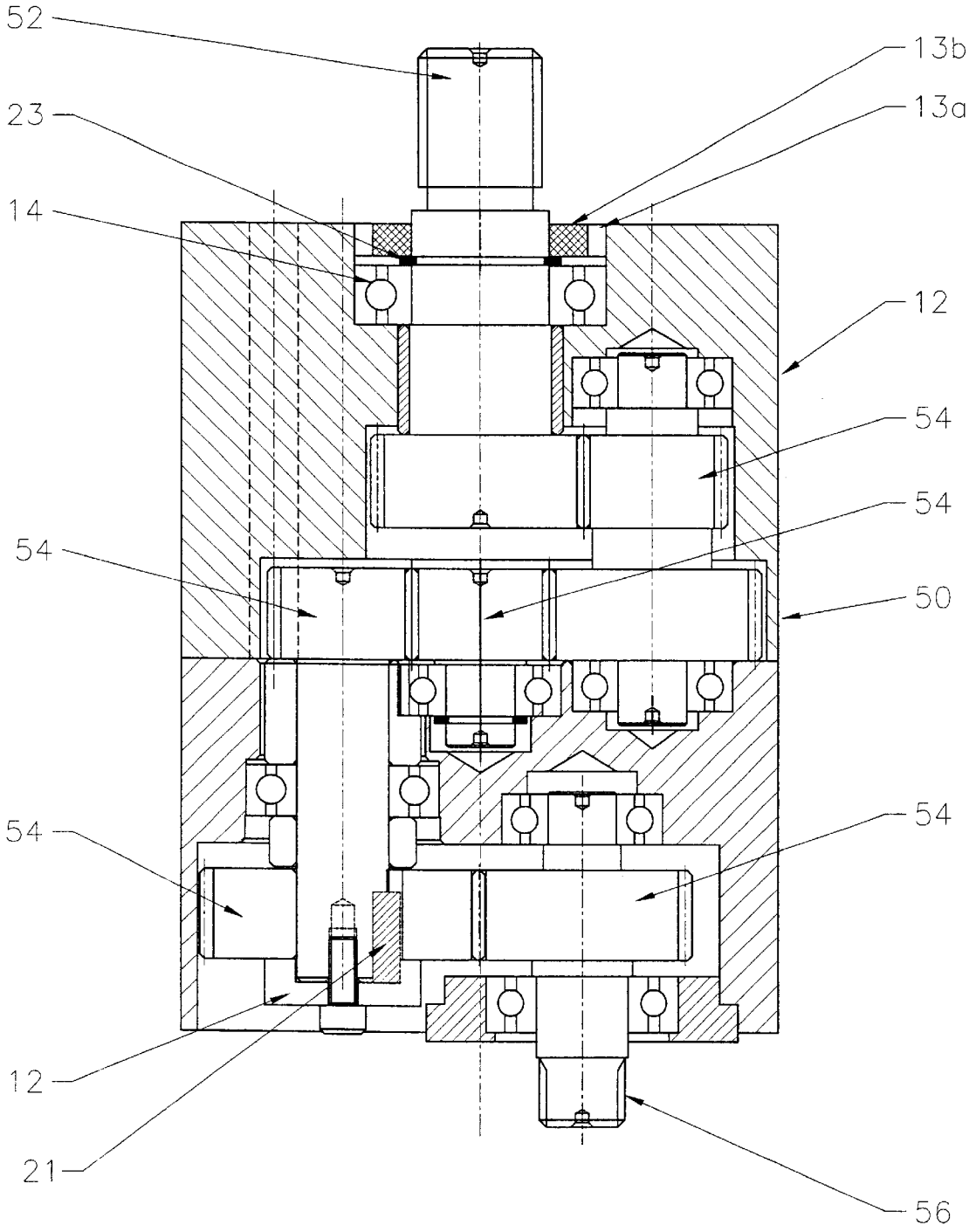
FIG. 5 is a cross-section of a preferred gear module of the present invention.

A volume rotor module (14V) preferably has a single fluid intake opening around the circumference of the rotor housing (20) such that fluid is drawn directly into the intake plenum (38). Alternatively, an intake opening (37) may be provided on the bottom of the rotor module, as is shown in FIG. 3. The upper rotor pair **(16*a*, 18*a*) drives a portion of this fluid upwards directly into an outlet plenum (40). The lower rotor pair (16*b*, 18*b*) drives a portion of the fluid downwards. This fluid is then redirected by a fluid passage (42) in the rotor housing to the outlet plenum (40) where the two fluid streams are rejoined and pass to the outlet (46). Because the fluid is split into two streams and pumped into opposite directions in the preferred embodiment, the rotor module (14)** is hydraulically balanced. It is possible to use a single rotor pair driving the fluid in one direction only. Although such an embodiment is not preferred, it is still within the scope of this invention.

A pressure rotor module (14P) preferably has a single intake opening (48) which is provided in the bottom gear housing (29) and which leads to an intake fluid passage (51) in the rotor housing (20) which leads to the intake plenum (38). There the fluid stream is split between the two rotor pairs **(16*a*, 18*a* and 16*b*, 18*b*) in the same manner as in the volume rotor module (14V) and discharged through the outlet plenum (40) and outlet (46)**.

Preferably, the housings (20) are hardened and coated with titanium nitride, as is well known in the art, to withstand abrasion and the stress of processing solids such as sand. The rotors are coated with titanium carbonitride, as is also well known in the art, to achieve a hardness in excess of 3000 Vickers. It is preferred to coat the rotors in order to deal with the sand which is produced in many oil wells without premature wear. Without protective coatings, the rotors (16, 18) may quickly wear from the abrasion caused by sand and other solids which may be present in the production fluid.

The gear module (12) is adapted to receive rotational energy from a surface driven sucker rod. The gear module

Figure 2:
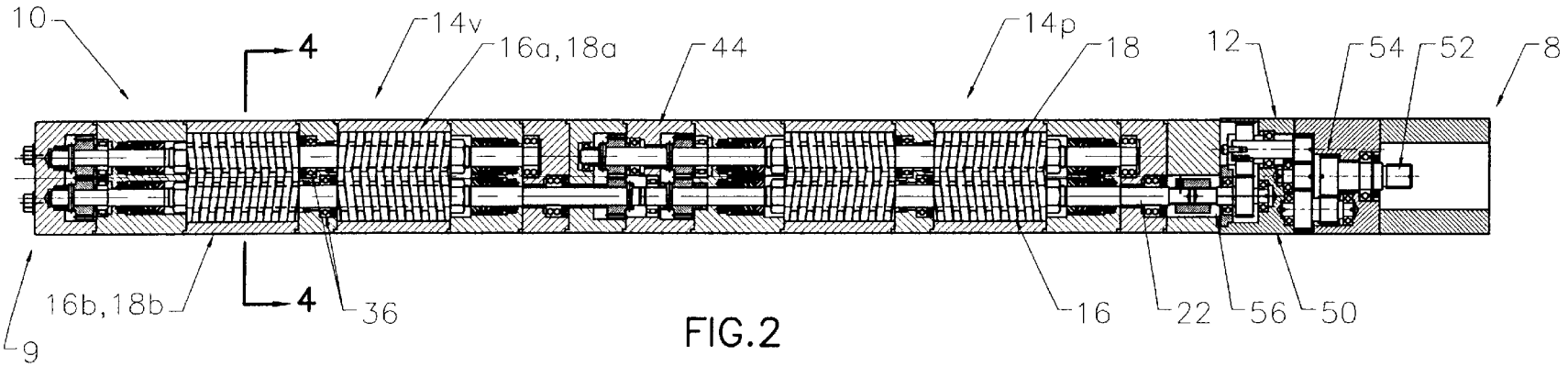
FIG. 2 is a cross-sectional view of a preferred embodiment comprising two rotor modules and a gear module.

(12) is positioned above the pump module or modules as is shown in FIG. 2. The gear module (12) comprises a gear housing (50), a power shaft (52), and an arrangement of gears (54) which are designed to multiply the rotational speed of the power shaft and drive the output shaft (56). The output shaft (56) connects with and drives the rotor shaft (22) of the rotor module (14).

Additional gear modules (44) may be provided between rotor modules (14) to transfer power between the rotor modules, as is shown in FIG. 2.

Figure 6A:
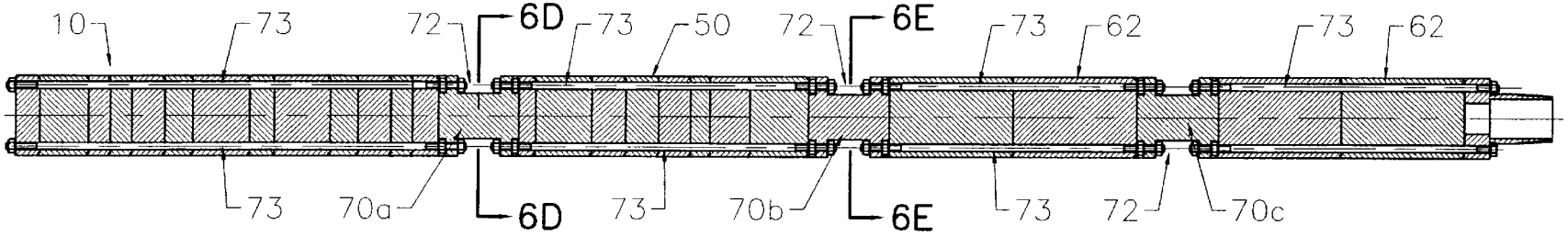
FIG. 6A is schematic representation of the bolting pattern of an alternative embodiment.
Figure 6B:
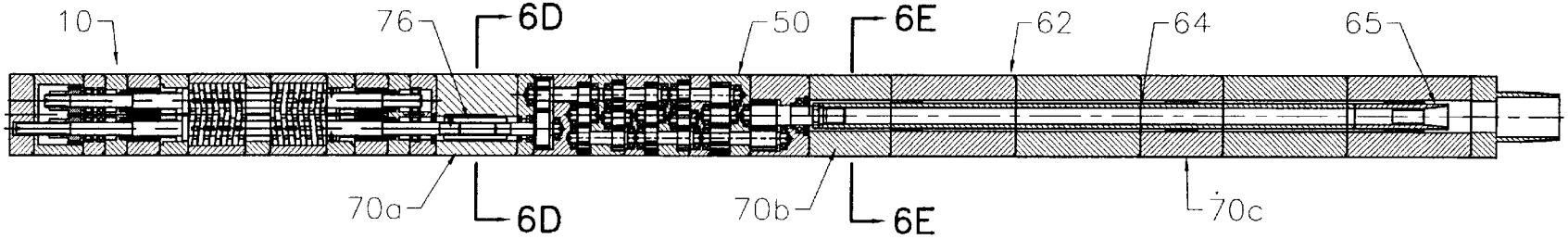
FIG. 6B is a cross-section of the embodiment shown in FIG. 6A.
Figure 6C:
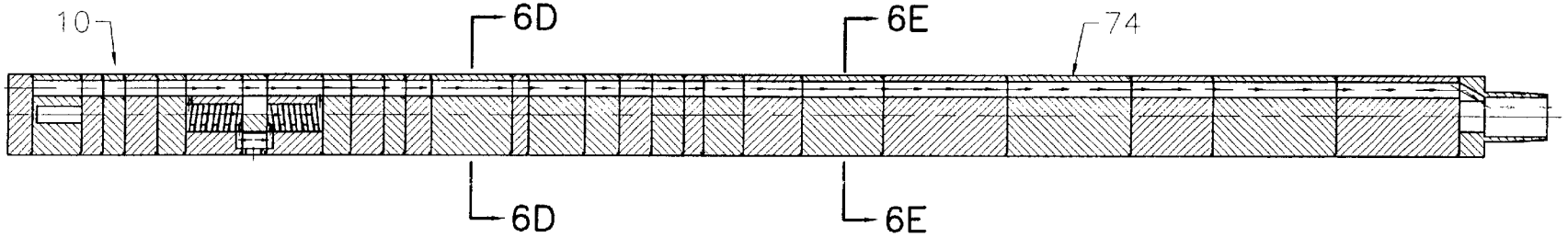
FIG. 6C is a cross-section along a plane normal to the plane of view in FIG. 6B.

A preferred embodiment of the pump (10) is shown in FIGS. 6A, 6B and 6C. In this configuration, the gear module (12) connects to a drive shaft module (60) which comprises an elongate housing (62) and a drive shaft (64) which accepts a male splined driver (not shown) at its top end (65) and connects to the gear housing (50) at its bottom end. It is important to have an extended drive shaft and an extended male spline driver because of the shortening effect on sucker rods when they are rotated. Essentially, the sucker rod will become twisted as it is rotated which will shorten its length. This effect becomes more pronounced as the sucker rod becomes longer and as it is rotated faster. To prevent the male splined driver from disengaging the drive shaft (64) as a result of a shortened sucker rod, it is necessary to significantly overlap the two.

Figure 6D:
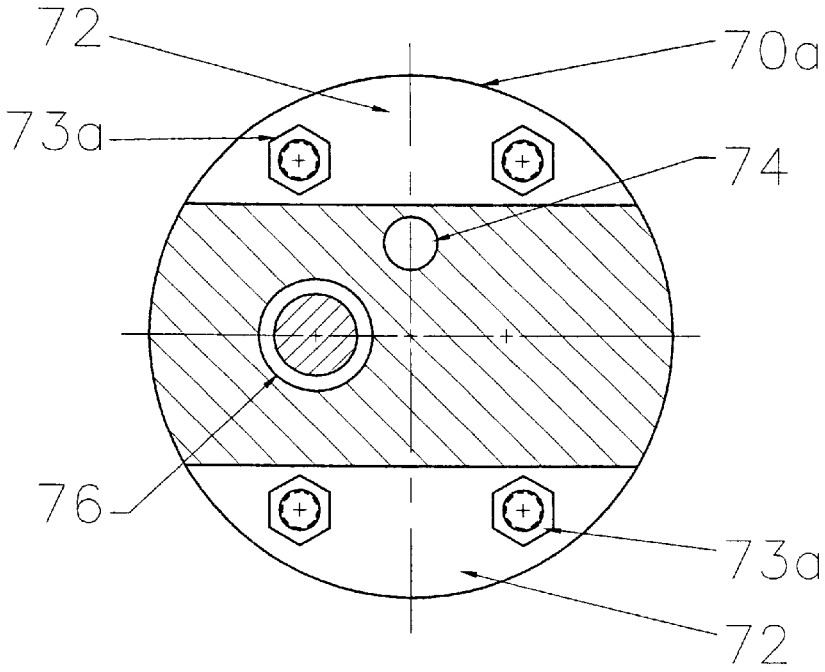
FIGS. 6D and 6E are transverse cross-sections along line 6D—6D and line 6E—6E respectively in FIGS. 6A, 6B and 6C.
Figure 6E:
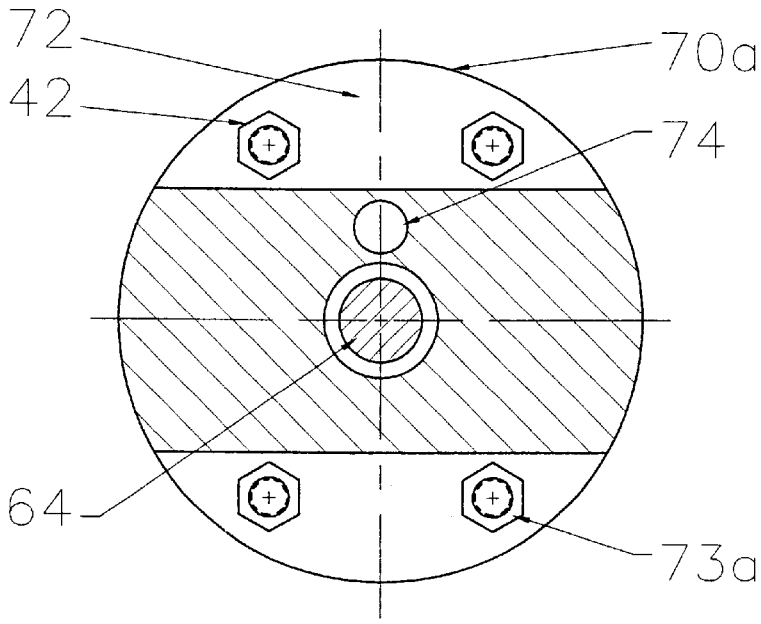

Also shown in FIG. 6A is a preferred bolting pattern using intermediate housings (70 ). The bottom intermediate housing (70*a*) spaces the rotor module (14) apart from the gear housing (50) while the others (70*b*, 70*c*) separate the gear housing (50) from the drive shaft module housing (62). The purpose of the intermediate housings (70) is simply to allow the use of shorter bolts (73) in assembling the pump (10). Each intermediate housing (70) has opposing recesses (72) to expose the bolt heads or nuts (73*a*) used to fasten the various housings and modules together as is shown in FIGS. 6A and 6D. A fluid passage (74) is provided to handle the fluid stream from the pump module. An intermediate drive shaft (76) connects the gear module (12) to the rotor shaft (22).

Sucker rods are typically rotated in the range of 50 to 600 rpm. The rotor modules (14) may be configured for efficient operation in a range of 400 to 1600 rpm for fluids having a viscosity equivalent to API 11 or 12 for crude oil. In such a case, the gear module (12) may be geared appropriately. For example, if the gear module (12) increases the speed threefold, then the sucker rod may be turned at about 350 rpm resulting in a rotor speed of 1050 rpm. For lighter, less viscous fluids, the rotors may turn at a much higher rate as a result of higher gearing in the gear module (12) or faster sucker rod speeds.

Figure 7A:
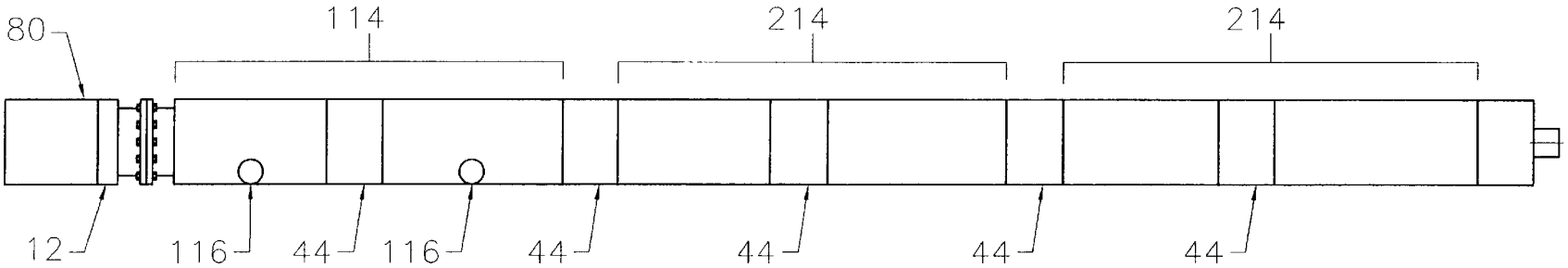
FIGS. 7A and 7B are schematic depictions of an alternative embodiment comprising a plurality of pressure and volume modules along with an electric submersible motor.
Figure 7B:
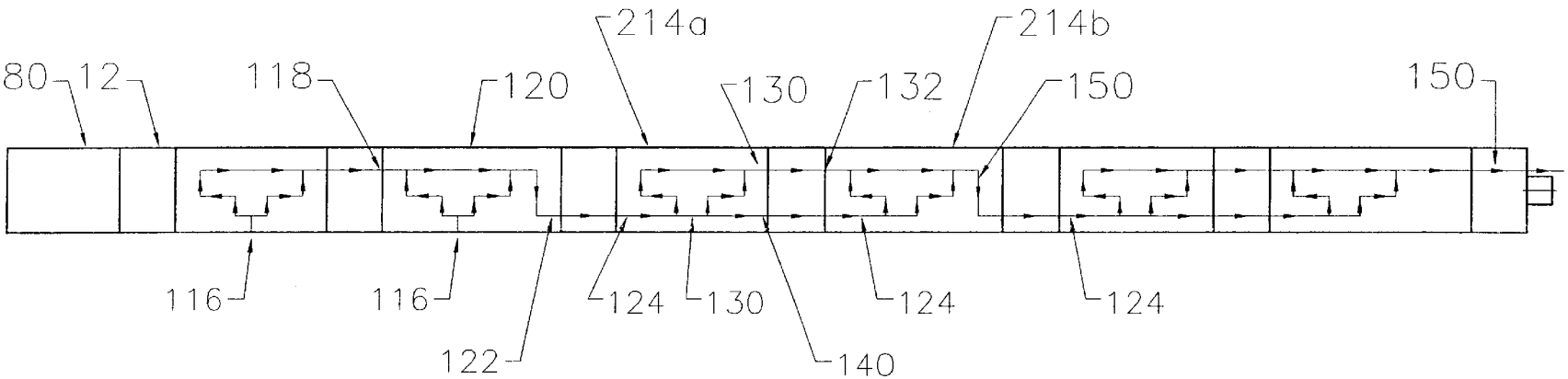

If it is desired to use a downhole electrical motor drive, the electric motor (80) may be positioned below the rotor module, as is shown in FIGS. 7A and 7B. In this case, the gear module (12) is adapted for use with electric motors which are capable of speeds well in excess of the speed capacity of the pump (10). Therefore, no speed increasing gear arrangement is necessary. However, some simple gears to centralize the rotor shaft to the electric motor shaft (not shown) may be necessary.

The intake opening of a pressure rotor module (14P) is adapted to cooperate with the outlet of either another pressure rotor module (14P) or with the outlet of a volume module (14V). Therefore, a pump of the present invention may have a plurality of pressure and/or volume modules connected in series to boost the volume and/or pressure capacity of the pump (10), as is schematically shown in FIGS. 7A, and 7B. As shown in FIGS. 7A and 7B, two volume modules (114V) are combined to form a single unit. In this embodiment, each volume module (114V) not only has a plurality of intake openings (116) around the circumference, but also an intake opening (118) in the bottom of the housing (120) which permits the module (114) to receive the output from another volume module (114V). This intake opening (118) may be blocked with a plug on the bottom most volume module (114V) or if only one volume module is provided.

The two volume modules (114) are connected to two twinned pressure modules (214) as is shown in FIGS. 7A and 7B. The first pair of pressure modules (214) accepts the output flow (122) of the volume modules through an intake (124). A first portion (130) of the flow enters the intake plenum of the first pressure module (214*a*). This fluid (130) is pressurized and is pumped to a flow receptor (132) in the second pressure module (214*b*). A second portion (140) of the flow passes through the first pressure module (214*a*) and enters the second pressure module (214*b*) through the intake (124). This second portion (140) is pressurized and pumped where it joins the output (130) of the first module (214*a*) as is depicted in the schematic flow diagram of FIG. 7B. The first pair of pressure modules then outputs the recombined flow (150) to the intake (124) of the second pair of pressure modules (214), where the same flow is repeated to further boost the pressure of the pump (10).

The clearance between the rotors (16, 18) and between the rotors and the rotor housing is preferably different for the different rotor modules. As the input pressure increases and the desired pressure boost increases, the clearances are preferably tighter. Generally, the volume modules have the largest clearances and the highest capacity pressure modules have the smallest clearances. In the example shown in FIGS. 7A and 7B, the two volume modules (114) each produce approximately 300 barrels per day at approximately 60 bar. The first pair of pressure modules (214) boosts the pressure to about 180 bar and the second pair of pressure modules (214) boosts the pressure to about 400 bar. As may be appreciated by a person skilled in the art, further or different flow rates and pressures may easily be achieved by varying the number of the different modules, the rotor clearances and the screw pitch or number of threads in each of the modules.

It is convenient to fabricate the various rotor modules in an identical fashion, each having the bottom intake (124) and flow receptor (132), the circumferential intake (116), and a flow bypass and a output. Each such rotor module may then be modified by plugging the appropriate opening or output to create a volume module, a pressure module or to create twinned volume or pressure modules as shown in FIG. 7B.

As will be apparent to those skilled in the art, various modifications, adaptations and variations of the foregoing specific disclosure can be made without departing from the teachings of the present invention.

The embodiments of the invention in which an exclusive property or privilege is claimed are defined as follows:

1. A modular pump for underground use in connection with an oil well, said pump comprising:

a) a rotor module comprising:

i) a cylindrical housing having a bottom face, a top face, a cylindrical face, an inlet, an outlet and an internal rotor enclosure between said inlet and outlet;

ii) an upper pair of intertwined and counter-rotating rotors and a lower pair of intertwined and counter-rotating rotors within the internal rotor enclosure, the upper pair of rotors and the lower pair of rotors being separated by an intake plenum wherein the upper pair of rotors drives fluid upwards into an outlet plenum and the lower pair of rotors drives fluid downwards into a fluid passage which then joins the outlet plenum;

iii) means for rotating the rotors; and b) a gear module having means for connecting to the drive source and means for outputting power to the rotor module.

2. The pump of claim 1 wherein the rotor module housing inlet comprises an intake opening in the cylindrical face of the housing, said intake opening being in fluid communication with the intake plenum.

3. The pump of claim 1 wherein the rotor module housing inlet comprises an opening defined in the bottom face of the housing and a inlet passage connecting the opening with the intake plenum.

4. The pump of claim 1 comprising at least one rotor module housing (hereinafter referred to as a "volume module") having an inlet comprising an intake opening in the cylindrical face of the housing, said intake opening being in fluid communication with the intake plenum and at least one rotor module housing (hereinafter referred to as a "pressure module") having an inlet comprising an opening defined in the bottom face of the housing and a inlet passage connecting the opening with the intake plenum, wherein the outlet of the volume module connects with the inlet of the pressure module.

5. The pump of claim 4 further comprising a plurality of volume and pressure modules connected in series.

6. The pump of claim 5 wherein the pressure modules are arranged in ascending order of pressure capacity.

7. The pump of claim 1 wherein the gear means is adapted for use with a sucker rod as power source.

8. The pump of claim 7 wherein the gear means comprises a gear box which increases rotational speed of the power source to the rotor module and which centralizes the power input.

9. The pump of claim 1 wherein the gear means is adapted for use with a downhole electrical motor as a power source.

10. A rotor module for use in assembling a modular pump for underground use in connection with an oil well, said rotor housing comprising a cylindrical housing having an upper surface, a cylindrical surface, a bottom surface and defining an internal rotor enclosure characterized in that:

an upper pair of intertwined and counter-rotating rotors and a lower pair of intertwined and counter-rotating rotors being positioned within the internal rotor enclosure, the upper pair of rotors and the lower pair of rotors being separated by an intake plenum wherein the upper pair of rotors drives fluid upwards into an outlet plenum and the lower pair of rotors drives fluid downwards into a fluid passage which then joins the outlet plenum the bottom surface defines an fluid intake opening that is in fluid communication with the intake plenum and a bypass opening;

the cylindrical surface defines lateral intake openings that are in fluid communication with the intake plenum; and the upper surface defines a bypass outlet opening and a fluid outlet opening, the fluid outlet opening being in fluid communications with the outlet plenum;

wherein each of the openings communicates with the rotor enclosure and some of the openings may be plugged while others are kept open to control the flowpath of fluid into and out of the housing such that two or more modules may be connected in series to increase the pressure and/or volume capacity of the pump.

* * * * *